United States Patent [19]

Anders

[11] Patent Number: 4,601,253

[45] Date of Patent: Jul. 22, 1986

[54] OFFSHORE BOARDING APPARATUS

[76] Inventor: Robert A. Anders, 6725 Brittmore, Houston, Tex. 77041

[21] Appl. No.: 747,798

[22] Filed: Jun. 24, 1985

[51] Int. Cl.[4] ..... B63B 17/00

[52] U.S. Cl. ..... 114/362; 182/196

[58] Field of Search ..... 114/362, 230, 221 R; 441/80; 182/93, 196

[56] References Cited

U.S. PATENT DOCUMENTS

| | | | |
|---|---|---|---|
| 260,245 | 6/1882 | Schmidt | 182/196 |
| 1,124,115 | 1/1915 | Dubrule et al. | 182/93 |
| 3,228,051 | 1/1966 | Voase et al. | 114/230 |
| 4,073,255 | 2/1978 | Paul | 114/230 |
| 4,115,887 | 9/1978 | Ewards | 114/362 |
| 4,298,092 | 11/1981 | Eriksson | 182/196 |
| 4,538,705 | 9/1985 | Leivestad | 182/142 |

*Primary Examiner*—Trygve M. Blix
*Assistant Examiner*—Thomas J. Brahan
*Attorney, Agent, or Firm*—Guy E. Matthews

[57] ABSTRACT

This invention relates generally to an apparatus for boarding or leaving an offshore structure or ship safely. More particularly, the invention relates to a swing beam and flexible ladder to replace the current method for boarding an offshore structure.

6 Claims, 4 Drawing Figures

7
8
9
11
6
14
35
34
34
5
4
5
13

10
7
1
33
8
11
14
34
34

2
4
35
13
5
3
12

OFFSHORE BOARDING APPARATUS

FIELD OF THE INVENTION

This invention relates generally to an apparatus for boarding or leaving an offshore structure or ship safely. More particularly, the invention relates to a swing beam and flexible ladder to replace the current method for boarding an offshore structure.

DESCRIPTION OF THE PRIOR ART

The most common method now used for boarding an offshore drilling or production platform from a crew boat or supply boat consists of a single knotted rope attached to the platform. The person boarding a platform in their boat is expected to grasp the knotted rope and swing "Tarzan" style from the boat to the platform or vice versa. The procedure is hazardous at best even in a relatively calm sea since the passenger must time his leaping swing with the rise and fall of the boat. The procedure may be especially hazardous when using the rope to board the boat from the platform as the height of the boat relative to the platform is constantly changing and a passenger cannot know with any certainty the drop he must finally make into the boat.

Rope or flexible ladders have been used to board ships from a smaller boat for a considerable period. However, there have been no means provided to position the ladder over the boat and the danger exists that the boarding or disembarking passenger may be crushed between the boat and ship or structure to be boarded.

OBJECTS OF THE INVENTION

Considering the above, it is an object of the present invention to provide a safe method for boarding or disembarking from an offshore platform or ship from or into a smaller boat.

It is a further object of this invention to provide a relatively simple construction of said apparatus and one that will be inexpensive thus to encourage the use of the apparatus.

SUMMARY OF THE INVENTION

In view of the above objects and considerations, an offshore boarding apparatus is provided comprising a horizontal support beam attached to an offshore structure by a hinge at one end supported by a cable or chain at the other end. A flexible ladder is attached near the outboard end which reaches to the water level. A rope is attached near the outboard end for pulling the beam out and over a boat which is adjacent to the offshore structure. The cable or chain is attached to the offshore structure above the hinge and offset a small distance inboard the structure to provide a slight tension on the beam toward the platform. The tension pulls the beam back toward the structure and holds it there when not in use.

PREFERRED EMBODIMENTS OF THE INVENTION

Figures 1, 2:
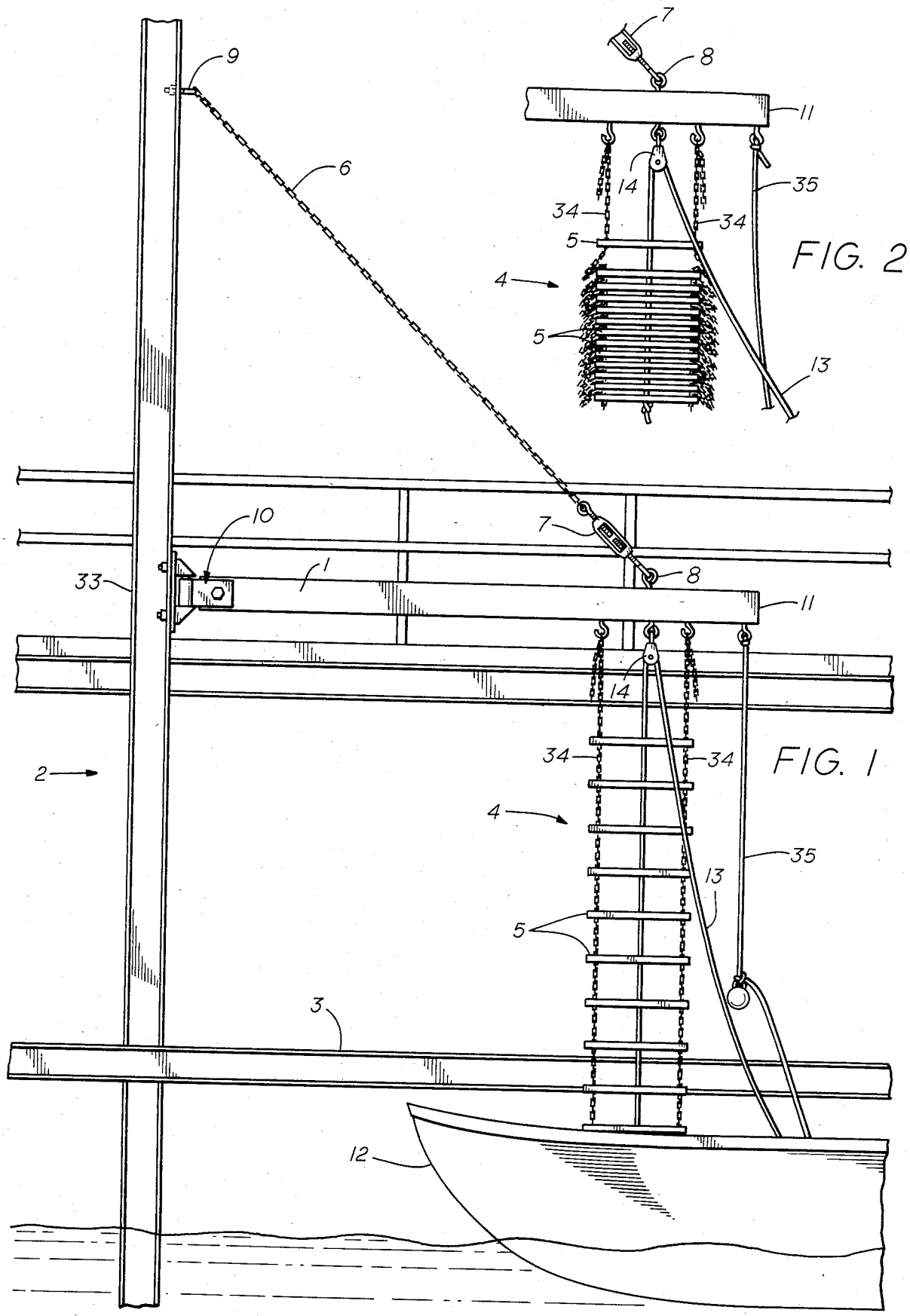
FIG. 1 is an overall side elevational view of the present invention as installed on an offshore drilling platform.
FIG. 2 is a side elevational view of the flexible ladder of the present invention installed on the support beam.

Referring now to the figures which show the preferred embodiment of the present invention, FIG. 1 is a side elevational view of the present invention as installed on an offshore drilling platform. A support beam 1 is attached to a girder 33 which is part of the offshore platform 2 by means of a hinge 10. One end of a support cable or chain 6 is attached to the girder 33 by means of an eye bolt 9 and attached to the free end 11 of the support beam using a turnbuckle 7 and another eye bolt indicated as 8. The turnbuckle 7 may be used to take up any slack in the support cable or chain. A flexible ladder generally indicated at 4 is shown attached to the support beam by use of the two chains 34. Rungs 5 are hung between the support chains 34 of the flexible ladder 4. As shown in the figure, the ladder is extending downward into a boat 12. A retrievable return rope 35 is also attached outboard of the ladder toward the free end 11 of the support beam. A weight is attached to the lower end of the retrievable rope to facilitate swinging the rope out into the boat. The ladder may be raised or lowered by means of another rope 13 which is attached to the bottom rung and passed through the pulley 14 and back downward to near the water level.

FIG. 2 shows the ladder in the completely raised position wherein all the rungs are brought together by pulling on the rope through the pulley 14.

Figure 3:
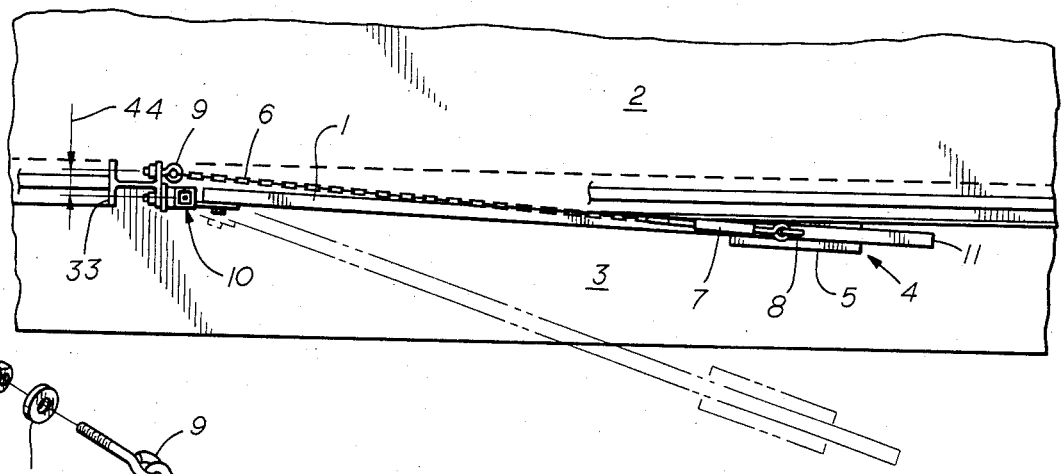
FIG. 3 is a top plan view of the present invention.

FIG. 3 shows a top plan view of the support beam resting against the platform 2. As may be seen, the eye bolt 9 attaching the upper end of the support cable to the girder at 33 is offset a small distance 44 toward the inside of the platform from the hinge 10. This small offset applies a tension to the free end of the support beam 1 toward the platform, keeping it resting against the platform when not in use.

Figure 4:
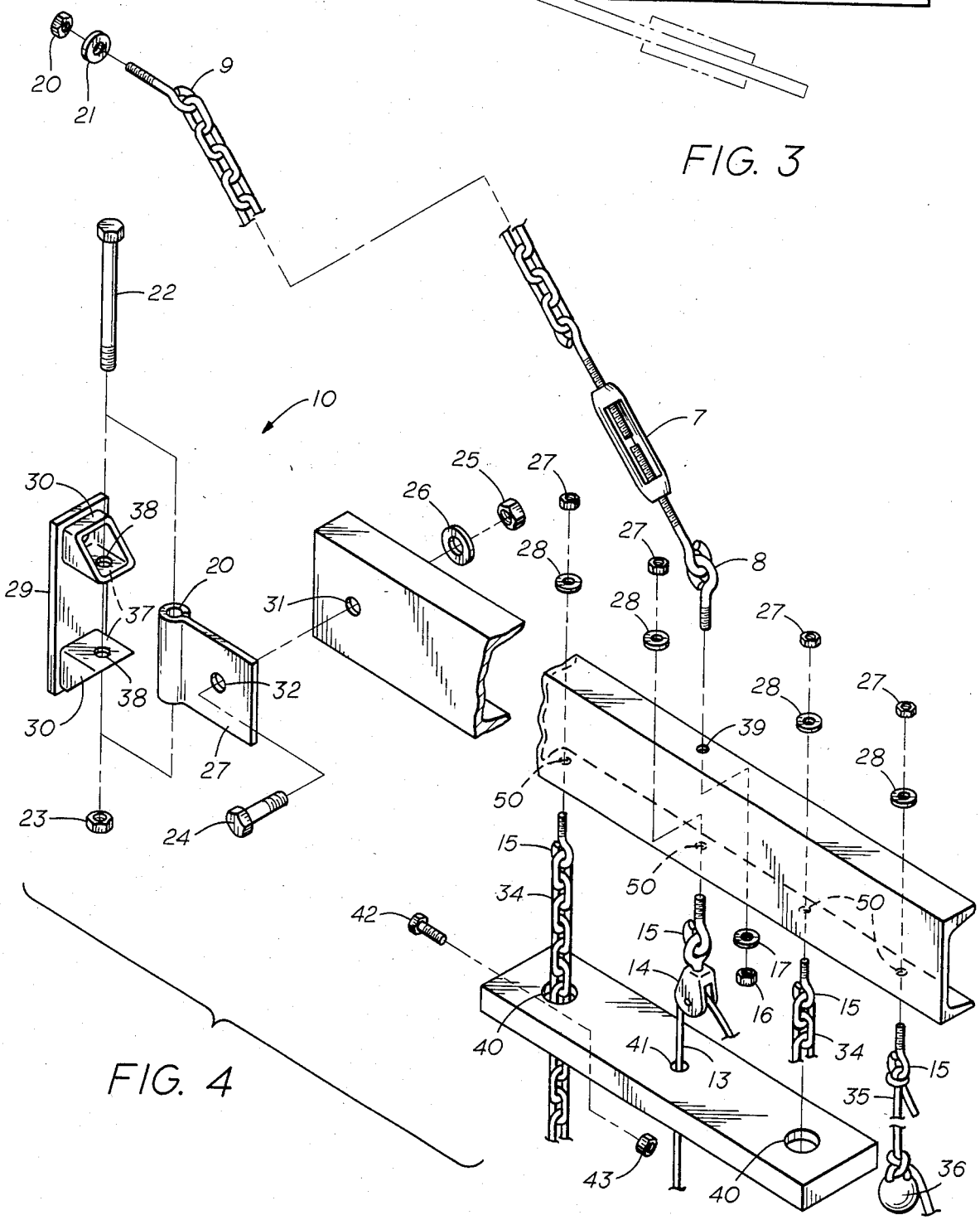
FIG. 4 is an exploded view of the present invention showing the flexible ladder attached to the support beam and the support beam attachment to the offshore structure.

Referring now to FIG. 4, a blow-up drawing of the beam, the hinge and the ladder is shown. The hinge 10 is shown to comprise a gudgeon plate 29, two gudgeons indicated at 30 a hinge plate indicated at 27 and a pintle indicated at 22. The gudgeons are simply constructed from steel box tubing cut at an angle such that one surface 37 is exposed from the opposite when viewing from the opposite side. Holes 38 are drilled in the surfaces 37. The angle cut boxes are then welded onto the gudgeon plate in the manner shown with the opened angled part of the boxes facing away from one another. The hinge plate 27 is attached to the support beam 1 by means of a bolt 24 which passes through a hole in the plate 32 and a hole in the beam at 31 and is secured there using the nut 25 and washer 26. The hinge plate is inserted between the gudgeons and the pintle indicated at 22 to be a simple long steel bolt is then passed through the first gudgeon, then the hinge plate, and finally the bottom gudgeon and secured there by a nut 23. This hinge configuration is simple to manufacture and install.

The attachment of the cable to the platform and the beam is effected by an eye bolt 17 which is attached through a hole 39 in the support beam by means of a nut 16 and washer. A turnbuckle 7 is then attached to the eye bolt 17 and to the chain 6. The opposite end of the cable is then attached to the offshore structure by means of an eye bolt 9 and nut and washer 20 and 21. Eyehooks 19 attach the chain to the eye bolts 9 and the turnbuckle 7.

Now referring to the attachment of the are ladder and pulley, the chains of the ladder 34 and the pulley 14 are all attached to the beam 1 by means of eye bolts 15 and nuts 27 and 28. In one embodiment of the invention which is shown, the steps on the ladder are flat and constructed of fiberglass with holes 40 on either side through which the chains 34 may pass. The steps are fastened to the chain by means of bolts 42 and nut 43. (Only one side shown.) Additionally, a hole 41 is provided in each of the steps through which is passed a raising/lowering rope 13. The raising/lowering rope is then attached to the bottom rung of the ladder such that when the rope is drawn upward, the flexible ladder raises in a flat pattern.

The operation of the boarding ladder is described in conjunction with FIG. 1. The boat 12 pulls up to the loading dock 3 and a person standing on the loading dock takes the weight 36 and swings the retrievable rope 35 outwardly such that a person on the boat may grasp it. The person or the boat then pulls outward on the rope 35 and swings the support beam 1 out and over the boat bringing along with it the ladder. The ladder 4 is then lowered by use of the rope 13 down into the deck of the boat where the person to board the platform climbs up several rungs of ladder to a height such that he will clear the level of the loading dock. The person holding the retrievable rope 35 may then release the retrievable rope and due to the small amount of tension provided by the offset 44, the support beam will swing slowly back toward the drilling platform until the person on the ladder is above the loading dock at which time the ladder may be lowered and the passenger may disembark on the loading dock. Boarding a boat from an offshore platform is a simple reverse of this procedure, i.e., the passenger climbs the ladder while it is above the loading dock and then the retrievable rope 35 is passed outwardly to the boat 12 such that the support beam 1 may be swung out and over the deck of the boat 12; the ladder may then be lowered by use of the rope 13 until it reaches the deck of the boat at which time the passenger can disembark in complete safety.

What is claimed is:

1. An apparatus for boarding or leaving an offshore structure located in the water such as a drilling platform or ship said offshore structure having a landing platform and vertical support members, said apparatus comprising:

(a) a horizontal support beam having an attachment end and a free-swinging end rotatably attached at said attachment end to one of said vertical support members by a pivot means defining a vertical pivot axis and supported near said free swinging end by a cable, chain or the like one end of which is fixedly attached to said beam near said free-swinging end and the other end being fixedly attached to said vertical support member above said pivot means;

(b) a flexible ladder fixedly attached near said free end and extending downward to the water level;

(c) a pulling means attached to said beam and accessible to a boat adjacent to said structure for pivoting said support beam out and away from said offshore structure over the water; and (d) a self-returning means for automatically returning said free end towards the offshore structure and holding it securely against said offshore structure above said landing platform.

2. The apparatus of claim 1 wherein said pivot means comprises:

(a) a rectangular gudgeon plate of steel or other suitable material fixedly attached to said offshore structure;

(b) a pair of gudgeons, the first fixedly attached near the top of said gudgeon plate, the second fixedly attached near the bottom of said gudgeon plate;

(c) a hinge plate fixedly attached to said attachment end of said support beam, said hinge plate having a receptacle for a pintle, said receptacle being disposed between said gudgeon; and (d) a pintle passing through the top gudgeon, then through the hinge plate receptacle and thence through the bottom gudgeon on the plate to rotatably secure said support beam within th hinge and to said offshore structure.

3. The apparatus of claim 1 wherein said return means comprises a support cable or chain or the like one end of which is fixedly attached to said free-swinging end and the opposite end being fixedly attached to said offshore structure at a height above said pivot axis substantially equal to the length of said support beam and offset from a vertical line through said pviot axis toward the inside of said offshore structure such that tension is applied to said free end causing said support means to swivel towards said offshore structure.

4. The apparatus of claim 1, wherein said flexible ladder comprises:

(a) two chains fixedly attached near said free-swinging end of said support beam and spaced apart a convenient horizontal distance along said support beam; and (b) a plurality of flat fiberglass rungs vertically spaced apart and fixedly attached between said chains, each of said rungs being in a horizontal plane and defining a vertical hole through the center.

5. The apparatus of claim 4 including a raising/lowering means for changing the level of the lower end of said flexible ladder, said raising/lowering means comprising (a) a pulley fixedly attached to said support beam such that it is intermediate the rungs of said flexible ladder;

(b) a rope fixedly attached to the bottom rung of said flexible ladder and passed up and through said holes and through said pulley and down and near the water level.

6. The apparatus of claim 1 wherein said pulling means comprises a single rope attached to said free swinging end of said support beam and extending downward to the water level, said rope having a weight attached to the lower end to facilitate the swinging out of the rope to the boat or other structure being boarded from.

* * * * *